United States Patent [19]

Bryant

[11] 4,384,383

[45] May 24, 1983

[54] PUSH-TYPE BROOM

[75] Inventor: William C. Bryant, Bell Arthur, N.C.

[73] Assignee: Empire Brushes, Inc., Greenville, N.C.

[21] Appl. No.: 335,063

[22] Filed: Dec. 28, 1981

[51] Int. Cl.[3] ..... A46B 15/00

[52] U.S. Cl. ..... 15/159 R; 15/146; 15/176

[58] Field of Search ..... 15/159 R, 171, 176, 15/145, 146

[56] References Cited

U.S. PATENT DOCUMENTS

| | | | |
|---|---|---|---|
| 689,941 | 12/1901 | Wilson . | |
| 2,251,857 | 8/1941 | Rose . | |
| 2,705,336 | 4/1955 | Wilson . | |
| 2,845,651 | 8/1958 | Woodruff . | |
| 3,218,662 | 11/1965 | Fielder, Jr. | 15/145 |
| 3,256,048 | 6/1966 | Rea | 15/146 X |
| 3,707,739 | 1/1973 | Hermann, Jr. | 15/176 |

FOREIGN PATENT DOCUMENTS

| | | | |
|---|---|---|---|
| 569723 | 2/1933 | Fed. Rep. of Germany . | |
| 148398 | 1/1937 | Fed. Rep. of Germany | 15/176 |
| 668740 | 12/1938 | Fed. Rep. of Germany | 15/145 |
| 1106155 | 7/1955 | France . | |
| 806145 | 12/1958 | United Kingdom . | |

*Primary Examiner*—Peter Feldman

*Attorney, Agent, or Firm*—Kirschstein, Kirschstein, Ottinger & Cobrin

[57] ABSTRACT

A push-type sweeping broom having a handle with a connector end terminating in a reduced-diameter threaded section and a broom block, preferably of molded plastic material, with a raised inclined mound on the upper surface thereof surrounding a blind bore adapted to receive the connector end of the handle. The bore has an upper portion and a lower portion, the lower portion being of reduced diameter in comparison with the upper portion and having threads on its walls. The connector end of the handle is inserted into the bore until the threaded terminal section thereof engages the threaded lower portion of the bore, and the handle is then tightly screwed into the bore, with the upper portion of the bore and the surrounding mound snugly receiving and supporting a portion of the connector end of the handle. The broom block has a plurality of discrete groupings of bristles distributed across its lower surface.

7 Claims, 2 Drawing Figures

PUSH-TYPE BROOM

BACKGROUND OF THE INVENTION

1. Field of the Invention

A push-broom for sweeping or cleaning hard horizontal surfaces.

2. Description of the Prior Art

Brooms used for sweeping or cleaning hard horizontal surfaces, e.g. wood, tile, cement, linoleum, asphalt and other uncarpeted surfaces, are available in a variety of sizes, shapes and constructions, some of which are particularly suitable for a specific cleaning task or specific type of surface. Whereas an ordinary kitchen-type broom, having an elongated handle with a tied bundle of broom straws attached at one end, with the handle and bristles oriented along the same axis of symmetry, is adequate for sweeping relatively small areas, such as are found in the home, it has been discovered that a push-broom is far more suitable for sweeping loose dirt and particles from a large surface area.

A push-broom is characterized by having an elongated handle attached to a block, almost always of wood, which is generally rectangular in plan and which has discrete bundles of bristles attached to the underside thereof, i.e. the side which faces away from the handle-block connection, much in the nature of a brush.

In the typical prior art push-broom, a blind cylindrical bore is provided in the upper surface of the broom block, i.e. the surface opposite the bristles, adjacent to one ot its longer edges. The bore is formed with a female thread for all or a part of its length and is inclined so that its axis is perpendicular to the longest axis of the rectangular block, and is at an oblique angle with respect to the plane of the upper surface of the block. The broom handle is provided at its lower end with a male thread that is shaped and dimensioned to permit the handle to be screwed into the bore and secured. Some push-broom handles are secured in a permanent fashion to the blocks by L-shaped metal straps or brackets, each of which has one leg secured to the lower end of the broom handle and the other leg secured to the upper surface of the broom block.

A push-broom is utilized by holding the upper end of the handle at an angle which will position the broom bristles on the underside of the block so that they are substantially perpendicular to the floor for maximum sweeping contact and dirt displacement, and the broom is then pushed in front of the user. Generally, the angle defined by the broom handle and the upper surface of the block is such that a person can comfortably push the broom in front of him while holding the upper end of the handle and maintain the bristles in their optimum cleaning position. The dirt and particles to be swept from the floor are then pushed in front of the user until they are displaced to a desired location where they can later be picked up and discarded.

Certain variations on the above-described conventional push-broom construction have been developed in the prior art. For example, U.S. Pat. No. 2,705,336 discloses a push-broom having a block with a substantially domed-shaped upper surface rather than a flat surface with perpendicular dependent walls. In addition, the broom disclosed in that patent has a reversible handle that is provided with a connector structure at each end, with the end to be held by the user covered by a removable cushioned cap. Moreover, the broom shown in that patent has no reinforcing metal straps or brackets but merely has at each connector end a threaded portion of somewhat reduced thickness which screws into a fully threaded bore in the broom block.

British Pat. No. 806,145 discloses a broom having a plastic (such as polyethylene) block with a protruding socket having internal ribs or serrations. The socket is sufficiently resilient to grip the end of the broom handle when it is forced into the socket, but the ribs within the socket hold the handle firmly by frictional contact. The broom handle is not threaded to any extent and can be reversed so that either end may be thrust into the resilient socket in the block.

All of the above push-broom constructions have distinct advantages both with respect to their method of manufacture and with respect to their durability and effectiveness in use. The production of the conventional push-broom construction described above, having a threaded blind bore in a wooden broom block, necessitates the carving of the bore and the threading thereof in the wooden block, which is a relatively costly and time-consuming process. Furthermore, because the length of the bore and of the threaded portion of the broom handle and because substantial force is exerted downwardly on the upper end of the broom handle by the user at an angle to the axis of the bore, the connection between the handle and the block requires reinforcement; thus, the additional manufacturing step of applying and securing the metal straps or brackets must be performed. In addition, once the brackets are secured, the broom handle can no longer be conveniently removed or replaced and the broom is normally discarded when the handle or block becomes worn or cracked.

The broom disclosed in the '336 patent, while providing for easy reversal or replacement of the broom handle, has a wooden block which must be carved, including the fashioning of the two blind threaded bores therein, and has a short, unsupported threaded connection between the handle and block which does not provide adequate strength or freedom from play. The British '145 patent does disclose a push-type broom with a plastic block, but that broom depends solely on the friction between the ribs in the resilient socket of the block and the end of the handle for the securing of the handle in the block. This type of connection is far more liable to cause axial slippage of the handle, as well as rotational slippage, than a threaded connection.

SUMMARY OF THE INVENTION

1. Objects of the Invention

It is an object of the present invention to provide an improved push-broom construction, which overcomes the aforementioned disadvantages of prior art push-brooms.

Another object is to provide a push-broom with a reinforced connection between the broom handle and the broom block.

A further object is to provide a push-broom with a reinforced handle connection wherein the handle can be easily unscrewed from the block and replaced when necessary.

An additional object of the present invention is to provide a push-broom that is easy and inexpensive to manufacture and comprises only a handle and a block without any additional support elements.

Still another object is to provide a push-broom with a block which can be easily molded from plastic material and which is durable, crack-resistant, and easily cleaned.

These and other objects and advantages of the present invention will become evident from the description that follows.

2. Brief Description of the Invention

The push-broom of the present invention comprises a broom block of generally oblong configuration having an upper surface and a lower surface, both of which are substantially of elongated rectangular shape. The lower surface of the block is provided with a plurality of brush-like bristles in discrete bundles, which bristles may be affixed in the lower surface of the block in any conventional manner, e.g. by stapling or plastic molding.

A support structure in the form of a raised inclined mound is situated on the upper surface of the block, proximate to the center of one of the long edges of said upper surface. A blind bore is provided in the center of the mound with a central axis that is approximately perpendicular to the long edge of the upper surface of the block and is at an oblique angle with respect to the plane of the upper surface.

The bore in the inclined mound has an upper portion adjacent to the open end thereof and a lower portion adjacent to the blind end thereof which is of reduced diameter in comparison with the upper portion and which has female threads provided on its walls. The upper and lower portions are connected by a seat.

The bore in the inclined mound on the upper surface of the block is suitable for receiving the connector end of a broom handle which has a lower terminal section of reduced diameter that is provided with male threads on the surface thereof. The terminal section is connected by a shoulder to the remainder of the broom handle. In assembling the push-broom, the threaded reduced end of the broom handle is tightly screwed into the threaded lower end of the bore in the block until the shoulder is received and seated firmly in the seat. The upper portion of the bore and the mound support the connector end of the broom handle above the threaded terminal section and restrict the lateral movement thereof, thus ensuring a secure and reinforced connection between the handle and the block.

The broom block can be fashioned from a variety of materials, but is preferably and most economically fashioned from moldable plastic material such as rigid polypropylene foam.

It will be appreciated by those skilled in the art that the push-broom construction described herein provides numerous salient advantages in comparison with prior art push-brooms, including ease and economy of manufacture, convenient replacement of worn or broken handles, durability and structural strength during use, and a reduced likelihood that play or loosening will develop or that slippage will occur in the handle-block connection.

DETAILED DESCRIPTION OF THE PREFERRED EMBODIMENTS

Figure 1:
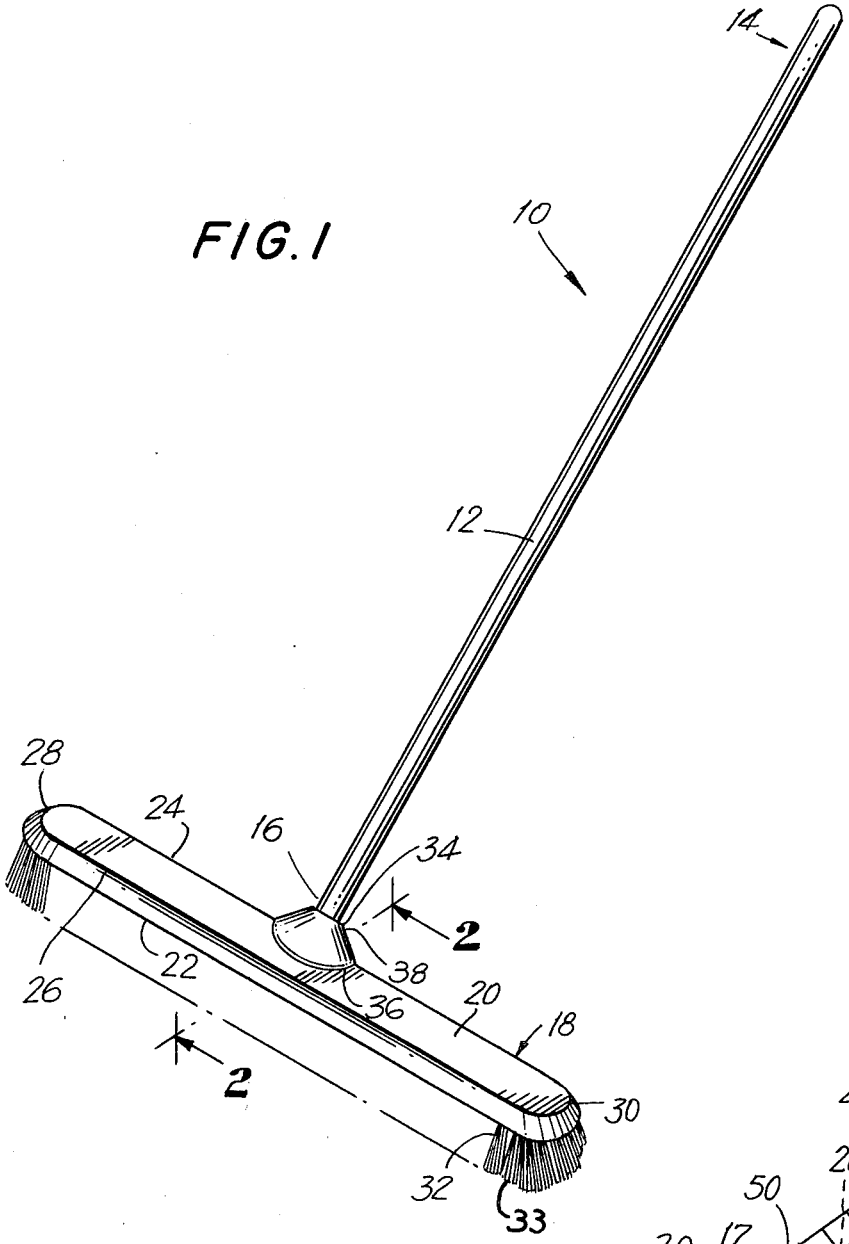
FIG. 1 is a perspective view of a push-broom according to the present invention.
Figure 2:
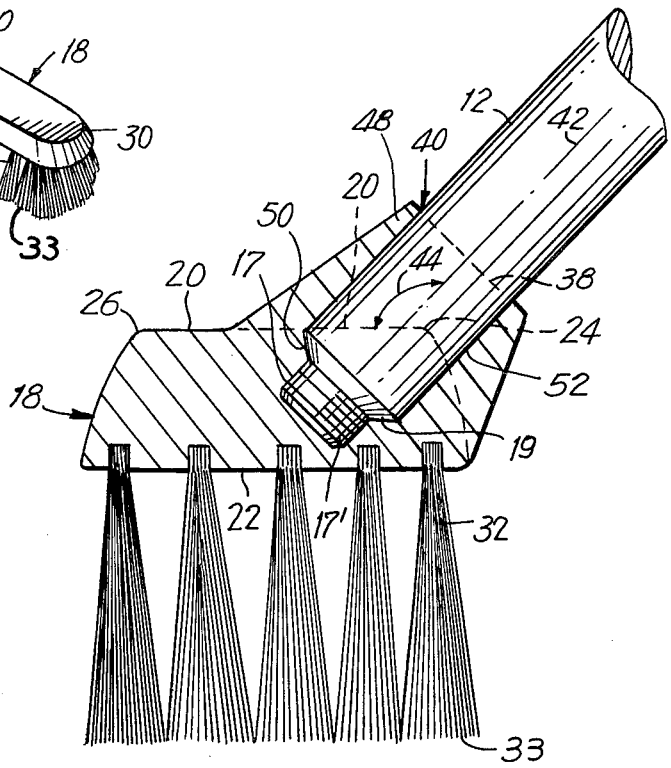
FIG. 2 is an enlarged fragmented sectional view taken substantially along line 2—2 of FIG. 1.

Referring now to the drawing, and particularly to FIG. 1, the push-broom of the present invention is denoted generally by the reference numeral 10 and comprises an elongated broom handle 12 having a grasping end 14 and a connector end 16 opposite the grasping end. As shown in FIG. 2, the connector end 16 has a terminal section 17 of reduced diameter which has male threads 17' provided thereon. A downwardly tapered shoulder 19 connects the terminal section 17 to the remainder of the connector end 16 of the handle.

The broom 10 includes a block 18 with an upper surface 20 and a lower surface 22, both of which have a generally oblong shape with a pair of long parallel lateral edges such as the edges 24, 26 of the upper surface 20, and rounded ends such as the ends 28, 30 of the upper surface 20. A plurality of discrete bundles of bristles 32 are affixed to the lower surface 22 of the block 18 and usually are uniformly distributed across the entire lower surface 22. The bristles 32 are affixed to the lower surface 22 in any conventional manner e.g. by stapling. The distal ends 33 of the bristles 32 lie in a common plane which is generally parallel to the upper and lower surfaces of the block 18.

Pursuant to this invention, a raised inclined mound 34 is situated on and is integral with the upper surface 20 of the block 18, adjacent to the long edge 24 of the upper surface 20 and approximately centered between the ends 28, 30 of said upper surface. The mound 34 is generally frusto-conical in configuration, tapering from its base 36 to its top 38. A rectilinear blind bore 40 is provided in the center of the mound 34 running axially from the top 38 thereof through the bottom 36 thereof and thence below the upper surface 20 of the broom block. The bore 40 and the mound 34 have approximately the same axis of symmetry 42 (shown as a dotted line in FIG. 2), which axis is generally perpendicular to the edge 24 of the upper surface 20 of the block 18, but which defines an obtuse angle with the plane of the upper surface 20, said angle denoted as 44 in FIG. 2.

The bore 40 has a lower co-axial portion 46 of reduced diameter, i.e. a diameter which is less than that of the upper portion 48 of the bore 40. This reduced diameter lower portion 46 of the bore has an axial length slightly shorter than the terminal section 17 of the broom handle 12, and is provided with female threads on the walls thereof. A tapered seat 50 is located in the bore between the upper portion 48 and the lower portion 46. The diameter of the bore is such as to receive the handle with a snug fit so that the handle (above the terminal section) is supported by the bore, thereby decreasing lateral stress upon the terminal section.

To assemble the broom 10, the connector end of the broom handle 12 is inserted into the bore 40 until its terminal section 17 abuts the lower portion 46 of the bore 40, just below the tapered seat 50. The handle is then rotated in a clockwise direction to cause the male threads on the terminal section 17 to detachably engage the female threads on the lower portion 46 of the bore, and the handle is then screwed tightly into place with the tapered shoulder 19 abutting the seat 50. When the handle is thus positioned, the upper portion 48 of the bore 40 encircles and supports a portion 52 of the connector end 16 of the broom handle 12.

In use, the broom handle 12 is grasped at its upper end 14 and is oriented so that the bristles 32 affixed to the lower surface 22 of the broom block 18 are generally perpendicular to the surface to be swept. Because the broom handle is inclined at an oblique angle from the plane of the upper surface 20 of the block 18 and hence is inclined at the same angle from the parallel plane of the bristle ends 33, the broom handle can be held in a comfortable position by a person of normal height and pushed along the surface to be swept in front of the user. In order to replace a worn or broken broom handle, the handle need only be unscrewed from the broom block and a new handle can be screwed into the block and tightened.

The broom block according to the present invention is preferably molded from plastic material, such as 70% grade rigid polypropylene foam. The block, with the raised mound, blind bore, and threaded reduced-diameter section of the bore can be easily and economically molded in accordance with conventional methods. Moreover, such a plastic block is more durable, crack and splinter-resistant, and esthetically pleasing, as well as easier to clean, than the more conventional wooden blocks generally used in prior art push brooms.

The handle of the push-broom of the present invention can be fashioned from a variety of materials, including wood, metal, molded plastic material, and so on. Because the push-broom of the present invention does not require metal support straps attached to the broom handle and block, as is common with prior art brooms of this type, there is no need to be concerned about selecting a material for the handle that can accept screw holes or other fasteners for the support elements. Any material that is sturdy and durable enough and can be fashioned into a handle with a reduced threaded section at its connector end can be utilized.

The broom of the present invention has an unusually strong, firm and play-free connection between the handle and block thereof by virtue of the screwing of the reduced section at the terminus of the connector end of the handle into the reduced-diameter lower end of the bore in the block, as well as because of the support provided by the walls of the upper end of the bore and the mound for a portion of the connector end of the handle above the reduced threaded end. This firm connection between handle and block is achieved without the necessity of any additional parts or connecting means, and enables easy replacement of the handle (or block) or detachment of the block from the handle for cleaning or storage purposes. Moreover, the configuration of the broom elements provides for easy and economical methods of manufacture as well as the need to produce only two components in order to construct the entire broom.

The invention illustrated and described herein is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various uses without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A push-broom for sweeping hard horizontal surfaces, comprising:

(a) an elongated handle having a grasping end and a connector end, said connector end having a terminal section of reduced diameter a shoulder being located between the connector end of the handle and the reduced diameter terminal section, said terminal section provided with male threads on the surface thereof;

(b) a block having an upper surface and a lower surface, said upper surface having a pair of lateral edges, said lower surface having affixed thereto a plurality of groupings of bristles extending away from the lower surface;

(c) a raised inclined support mound situated on and integral with and in one piece with the upper surface of the block, said mound having an axis of symmetry approximately perpendicular to one of the lateral edges of said upper surface and defining an oblique angle with the plane of said upper surface; and (d) a rectilinear blind bore running axially through the mound and extending below the upper surface of the block, said bore comprising an upper portion and a lower portion with a diameter less than that of said upper portion, said lower portion having walls provided with female threads adapted for detachable screw engagement with the male threads on the terminal section of the handle, said bore being adapted for receiving the connector end of the handle with the terminal section of the connector end threadedly engaging the lower portion of the bore and with the upper portion of the bore encircling and supporting a portion of the connector end of the handle situated above the reduced terminal section thereof said shoulder abutting against a seat in the bore situated below the upper surface of the block and with a lower part of the supported portion of the connector end of the handle being situated as well below the upper surface of the block.

2. A push-broom according to claim 1 wherein said block has a generally oblong configuration and said mound has a generally frusto-conical configuration, tapering from a base adjacent to the upper surface of the block to its top.

3. A push-broom according to claim 1 wherein said block is molded from plastic material.

4. A push-broom according to claim 3 wherein said plastic material is polypropylene foam.

5. A push-broom according to claim 1 wherein said shoulder and said seat are tapered and are in close abutting relationship, when the connector end of the handle is inserted into the bore and the terminal section thereof threadedly engages the lower portion of the bore.

6. A push-broom according to claim 1 wherein the mound and the bore running therethrough have the same axis of symmetry.

7. A push-broom according to claim 1 wherein the connector end of the handle fits snugly into the bore.

* * * * *